US006986575B1

(12) United States Patent
Gordon et al.

(10) Patent No.: US 6,986,575 B1
(45) Date of Patent: Jan. 17, 2006

(54) AUTOMATIC ROTATING MEDIA STRIPPER CARRIAGE FOR A PRINTER AND METHOD FOR MAINTAINING A PRINTER

(75) Inventors: Michael C. Gordon, West Linn, OR (US); Devin R. Bailly, West Linn, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/879,174

(22) Filed: Jun. 30, 2004

(51) Int. Cl.
*B65H 29/54* (2006.01)

(52) U.S. Cl. ..... 347/104; 101/118; 101/232; 271/308; 271/311; 271/312

(58) Field of Classification Search ..... None
See application file for complete search history.

(56) References Cited

U.S. PATENT DOCUMENTS 1,737,616 A * 12/1929 Saatman ..... 118/245
4,375,327 A * 3/1983 Matsumoto et al. ..... 399/323
4,387,981 A * 6/1983 Cormier ..... 399/399
4,761,667 A * 8/1988 Miyai et al. ..... 399/113
5,161,796 A * 11/1992 Okamoto ..... 271/308
5,241,354 A * 8/1993 Flynn ..... 399/323
6,293,545 B1 9/2001 Hanks et al. ..... 271/311

* cited by examiner

*Primary Examiner*—Andrew H. Hirshfeld
*Assistant Examiner*—Jill E. Culler
(74) *Attorney, Agent, or Firm*—Oliff & Berridge, PLC

(57) ABSTRACT

A printer assembly including a mechanism for rotating a stripper carriage includes a drum blade for stripping media from a drum and a transfix roller blade for stripping media from a transfix roller of an imaging device. The media stripper carriage is accessed and rotated so that a user may maintain parts of an imaging device without having to remove parts of the device. The stripper carriage pivots about a shaft of a transfix roller. A solenoid activates stripping of media from the drum and/or the transfix roller. When maintenance is required, the stripper carriage is rotated by a user and stops at an open position. The user may then clear a jam, clean parts or perform other maintenance on the imaging device. Then, an access door of the device is closed to automatically rotate the stripper carriage to a position in which the imaging device is ready for imaging.

20 Claims, 10 Drawing Sheets

AUTOMATIC ROTATING MEDIA STRIPPER CARRIAGE FOR A PRINTER AND METHOD FOR MAINTAINING A PRINTER

BACKGROUND OF THE INVENTION

1. Field of Invention

The present invention relates to imaging devices, particularly to a stripper blade assembly for removing a print medium from the surface of a roller and/or an imaging drum of an imaging device, and more particularly to a printer assembly including a mechanism for automatic homing and rotating of a media stripper carriage.

2. Description of Related Art

In an imaging process an intermediate image is printed onto a print surface of a drum, the print surface generally having a release agent coated on the surface of the drum. The intermediate image is then transferred from the print surface onto a print medium, such as paper or transparency material, in a transfer fusing process. More specifically, the image is transferred onto the print medium by passing the medium between a drum having a surface and a transfix roller. Heat and pressure is applied to the medium in a contact region (pressure nip) between the drum and the roller such that the image is transferred from the drum to the medium. Such a transfer process causes the medium to tend to adhere to the surface of the drum. Thus, after a leading edge of the medium emerges from the pressure nip, the medium must be stripped from the drum and guided to the next set of transport rollers.

To strip the medium from the drum, strippers are generally used. For example, it is known to use multiple, spring loaded, plastic fingers that are presented to the drum and media at a specified point. A stripper may only contact the drum in a leading edge margin to avoid disturbing the fragile image that has recently been transferred to the media. The transfix stripper blade may be a passive stripper with constant engagement to the roller surface. When forming an image on both sides of the media (duplex prints) or, for example, when using a highly curled media, such as, for example, a light weight stock paper, the media may also "stick" to the transfix roller. Thus, a stripper may also be used in connection with transfix rollers. If there is any damage to the print medium, such as a bent corner, a bent leading edge, a cut in the media or any other blemish in the media, or error in the print process, the result may be a serious jam that is difficult to clear and may require an expensive service call.

Accordingly, in the event that maintenance of the printer is needed, or for any other reason, a user may have to remove the stripper from the device. For example, in the event that the media jams at the imaging drum, transfix roller, or elsewhere, a user may have to open the printer or copier to clear the jammed media before continuing use. Many times, in order to reach the jammed media, different parts of the device must first be removed and then returned after the jammed media is cleared.

For example, as described in U.S. Pat. No. 6,293,545 (herein incorporated by reference), a stripper blade assembly for removal of a print medium from an imaging drum of a printer is described. The stripper blade assembly uses a thin, durable, flexible blade and the assembly is removable and installable by a customer. The blade, that extends the width of the drum, is mounted on a blade holder. The blade holder is detachably mounted on a shaft having an over molded connector. The entire assembly rotates or otherwise moves to present the thin edge of the blade to the drum along the axial length of the drum in order to strip the leading edge of the print medium from the drum at the appropriate point in the print process. However, a customer is required to remove parts of the printer in order to reach an intended area of the printer to clear a jam and then must correctly replace the parts before being able to resume printing.

Likewise, in many common printers, a user is required to remove the stripper from the printer in order to gain access to a jam, or, for example, to clean the blade. After the stripper is removed, other parts of the printer may also pose an obstacle to reaching the jammed media.

After a user removes or moves the stripper and/or other parts, each of these parts must be re-installed or returned to its original location before the printer may be used again. Printers may not have a mechanism that would alert the user that all parts have not been properly re-installed. If all the parts are not re-installed or not re-installed correctly, the printer will jam again.

In other known printing systems, various parts of the printer, including the stripper, are not easily removable. Thus, a user must attempt to clear a jam, clean parts, or for whatever reason, work inside the printer without the benefit of being able to move parts that may be in the way.

Accordingly, the present invention provides a system and method wherein the stripper and other parts may be more easily reached for maintenance, cleaning, or the like, without removing parts of the printer or damaging the print media or the parts of the printer.

SUMMARY OF THE INVENTION

There is a need for improved access to a printer for cleaning, maintenance or repair.

There is a need for a printer wherein it is easy for a customer to reach the drum and/or transfix roller in the printer without the need to remove printer parts.

There is a need for easier access to the parts of a printer with a reduced opportunity for damaging the printer.

There is a need for a stripper that can be readily moved out of the way and includes a mechanisms to ensure the stripper moves back to its proper position by closing of a door of the imaging device.

The above and other advantages are achieved by various embodiments of the invention.

Accordingly, the present invention provides a printer assembly including a mechanism for automatic rotating of a media stripper carriage and a method for maintaining a printer. That is a media stripper carriage may be easily accessed and rotated so that a user may, for example, access a stripper blade of the stripper carriage without having to remove any parts of the printer.

More specifically, an active drum media stripper and a passive transfix roller media stripper are both connected to a stripper carriage that pivots about a shaft of a transfix roller. By allowing for pivoting of the stripper carriage about the transfix roller shaft, intermittent, active drum media stripping and access to media jams or blade cleaning is easily achieved. Because the system is pivoting about the transfix roller shaft, the passive transfix stripper maintains constant engagement with the transfix roller as the system is run through its range of motion. This system is actuated with a solenoid for stripping of the print medium from a drum and/or a transfix roller. In a preferred embodiment, the stripper carriage stops at an open position (jam clear position) after the user rotates the stripper carriage out of the way, for example, for jam access. When the user has completed the object task, for example, clearing the jam, the user may simply close a door of the printer, whereby the stripper carriage automatically rotates to a ready position in which the printer is ready for printing.

BRIEF DESCRIPTION OF THE DRAWINGS

Other features of the present invention will become apparent as the following description proceeds and upon reference to the drawings, in which.

DETAILED DESCRIPTION OF PREFERRED EMBODIMENTS

Figure 6:
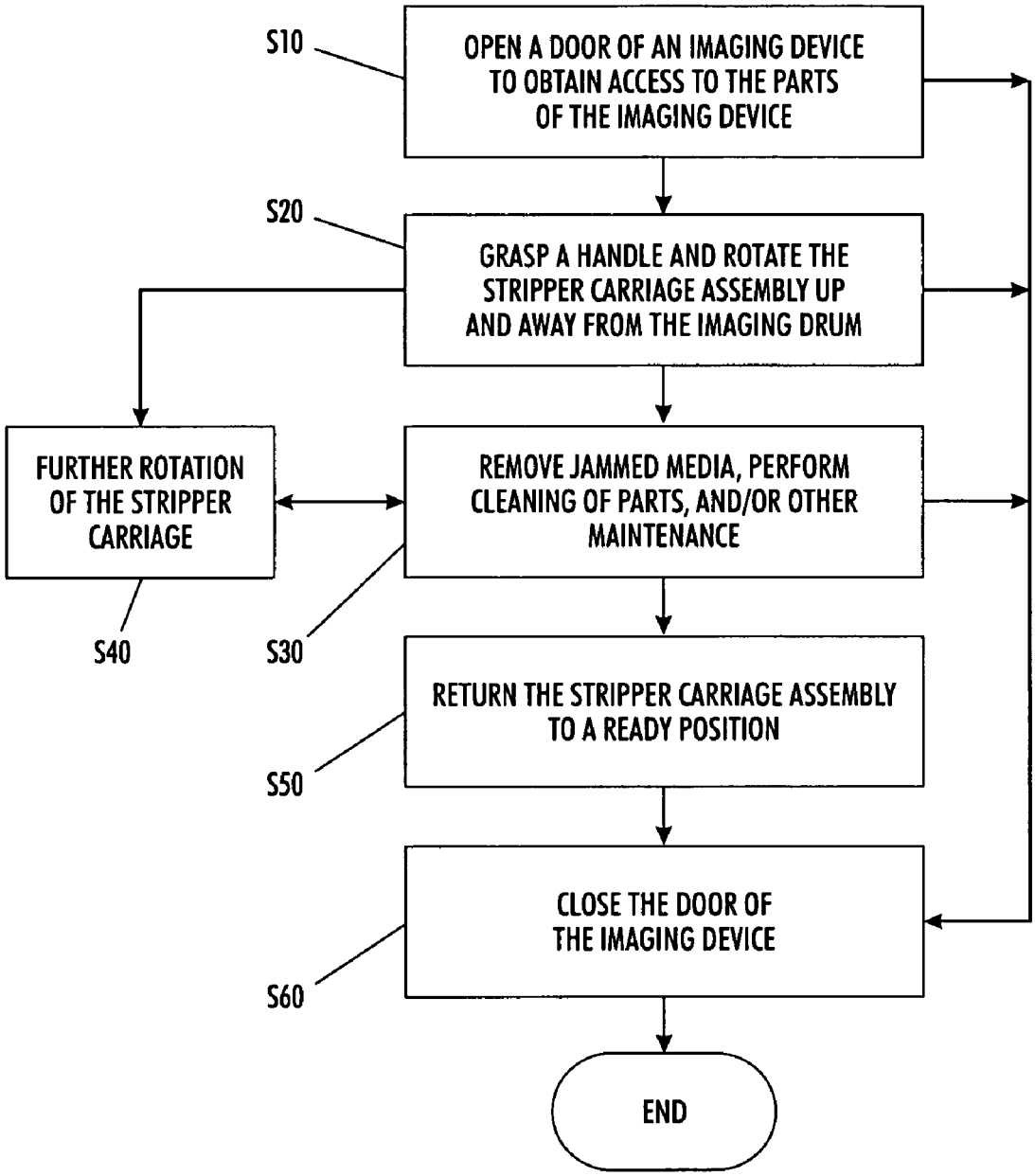
FIG. 6 is a flowchart illustrating a method for maintaining a printer in an embodiment of the present invention.
Figure 7:
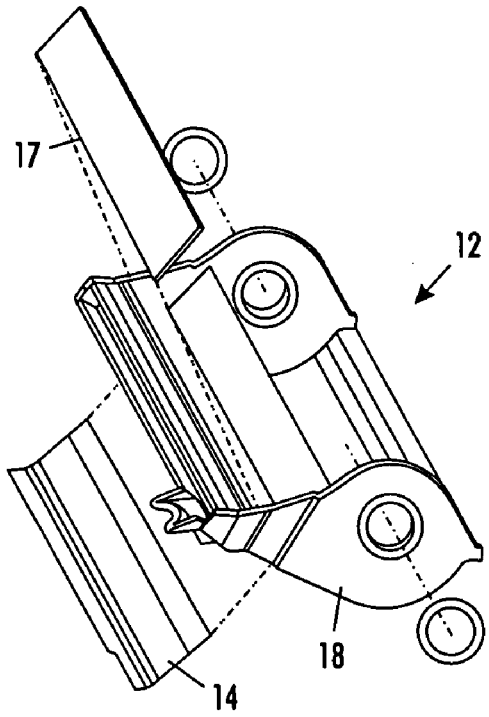
FIG. 7 illustrates a partially exploded view of a rotatable stripper carriage of an imaging device in an embodiment of the present invention.
Figure 8:
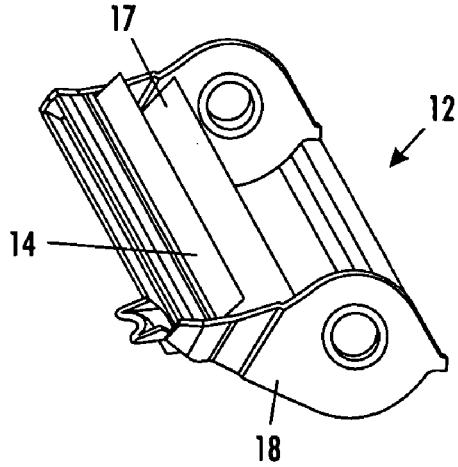
FIG. 8 illustrates an inside view of a rotatable stripper carriage of an imaging device in an embodiment of the present invention.

FIGS. 1–11 illustrate the components of a rotating media stripper carriage assembly 10 in an embodiment of the present invention. The assembly 10 includes a stripper carriage assembly 12 having a drum stripper blade 14 and a stripper carriage 18 which houses a transfix roller 15, whereby the transfix roller 15 and the stripper carriage 18 rotate about a shaft 20. The drum stripper blade 14 may be used to strip media 64 (see FIG. 2), such as, for example, paper, from a surface 22 of the imaging drum 24. Transfix ground pins 68 secure transfix load arms 70 to the drum. Referring also to FIGS. 7 and 8, the assembly 10 may further include a transfix roller stripper blade 17.

In use, when a paper jam occurs, removal of the paper or cleaning of the drum stripper blade 14 or the transfix roller stripper blade 17 may be needed. Or, for any other reason, a user may open a door 70 of an imaging device 80, such as, for example, a copier or printer, and swing the stripper carriage assembly 12 up and out of the way so that the jam, or parts that need maintenance, may be easily reached (see FIG. 4). In an embodiment, the stripper carriage assembly 12 may be moved by use of a handle 25 attached to the stripper carriage 18. For example, in an embodiment, when a user pulls the handle 25 in a backward direction, the stripper carriage assembly 12 begins to rotate about the shaft 20 of the transfix roller 15. Other embodiments with means to move the stripper carriage assembly 12 may also be employed. For example, movement of the stripper carriage assembly 12 may be triggered by closing the door 70 via contact between the assembly 10 and the door 70, or, for example, movement of the assembly 10 may be automated.

Referring again to FIGS. 1–5 and 9, in an embodiment of the present invention, a solenoid body 30 having a plunger 32 may actuate the assembly 10. The plunger 32 may retract into the solenoid body 30 or extend outside of the solenoid body 30. The solenoid body 30 is supported by a solenoid frame 33 attached to a solenoid bracket 38. The solenoid bracket 38 may be mounted to an upper inner duplex guide 40 of the printer. The solenoid body 30, the solenoid frame 33, the solenoid bracket 38, and the upper inner duplex guide 40 remain stationary relative to the rotatable assembly 10. In an embodiment, in addition to supporting the solenoid bracket 38, the upper inner duplex guide 40 may act as a media guide during the printing process. However, the solenoid bracket 38 may be attached to any stable part of the printer. Although the solenoid bracket 38 and the solenoid body 30 remain relatively stationary, the plunger 32 of the solenoid body 30, a lever arm 36 and the assembly 10 may all be movable parts of the printer. The lever arm 36 may be attached to the plunger 32 of the solenoid body 30 at one end by a rivet 31. The lever arm 36, at another end, is in contact with the stripper carriage 18.

Figure 1:
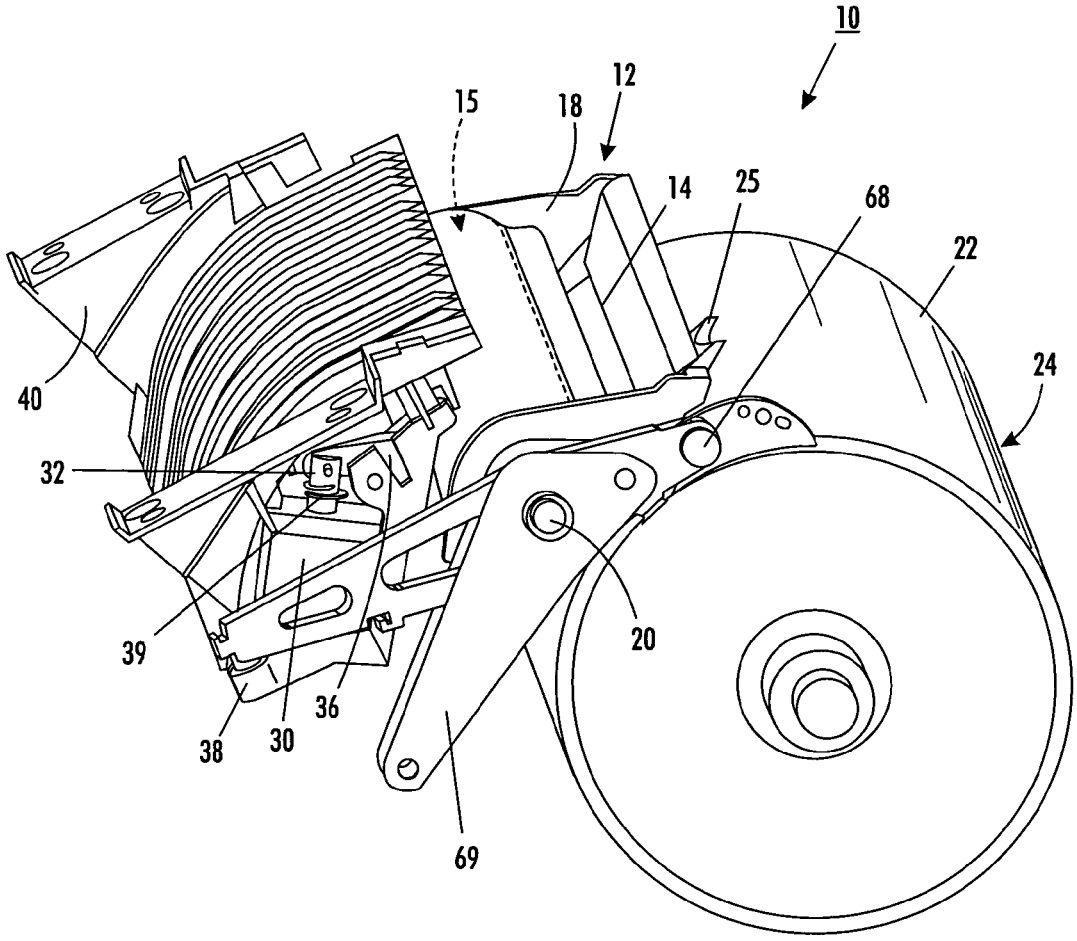
FIG. 1 illustrates a rotatable stripper carriage in an embodiment of the present invention.
Figure 2:
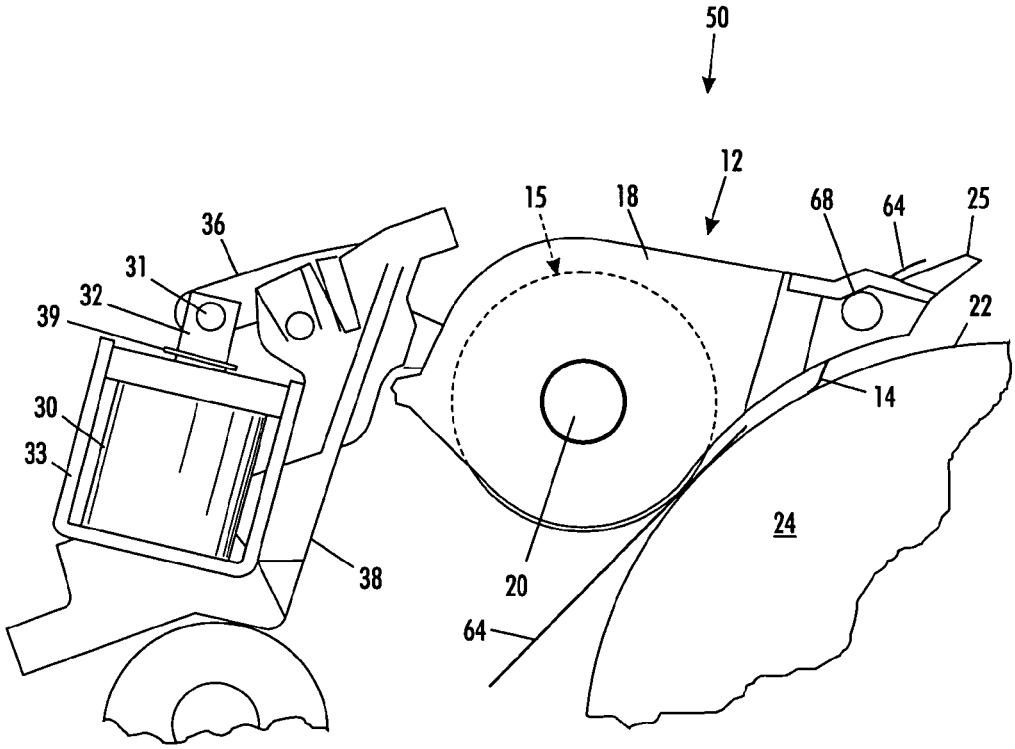
FIG. 2 illustrates a side view of a stripper carriage in a position in which a blade may scrape an image drum in an embodiment of the present invention.

When the solenoid body 30 is energized, the plunger 32 may be pulled into a solenoid body 30. The solenoid body 30 is energized with DC current based on a specific timing after a paper path position sensor is tripped. The solenoid is de-energized after a set time has elapsed. In other words, the solenoid body 30 is energized with DC current after the media has been staged. That is, the media may be stopped with a leading edge of the media in between the transfix roller 15 and the imaging drum 24. The solenoid body 30 is de-energized after the imaging drum 24 has rotated to a specific position. When the plunger 32 is pulled into the solenoid body 30, the lever arm 36, which is attached to the plunger 32, is pulled such that the lever arm 36 is forced to rotate which in turn rotates the stripper carriage 18 forward in a clockwise direction until the stripper carriage 18 reaches a hard stop position 50, as shown in FIG. 2. The stripper carriage 18 reaches the hard stop position 50 when the stripper carriage assembly 12 makes contact with the transfix ground pin 68. In the hard stop position 50, the drum stripper blade 14 is in position to strip the imaging drum 24. The drum blade 14 deflects against the imaging drum 26 and provides the force needed to strip the media from the drum 24.

When the solenoid body 30 is de-energized, a return spring 39, located around the plunger 32 of the solenoid body 30, provides a force to move the stripper carriage back from the hard stop position 50 to a ready position 54. The return spring 39 provides the force by strain energy imparted on the return spring 39 when it is compressed by the plunger 32 and an e-ring 41 (see FIG. 10). When the solenoid body 30 is de-energized, the compressive force on the return spring 39 is removed and the return spring 39 expands so as to return to its lowest energy state. The return spring 39 expands, causing the plunger 32 to protrude from the solenoid body 30. The return spring 39 pushes on the e-ring 41 which pushes on the plunger 32, which pushes on the rivet 31, which pushes on the lever arm 36, causing the lever arm 36 to rotate. The energized solenoid 30 creates a magnetic field which pulls the plunger 32 into the solenoid body 30.

This causes the return spring 39 to compress because the e-ring 41 which is connected to the plunger 32 puts a compressive force on the return spring 39.

Figure 3:
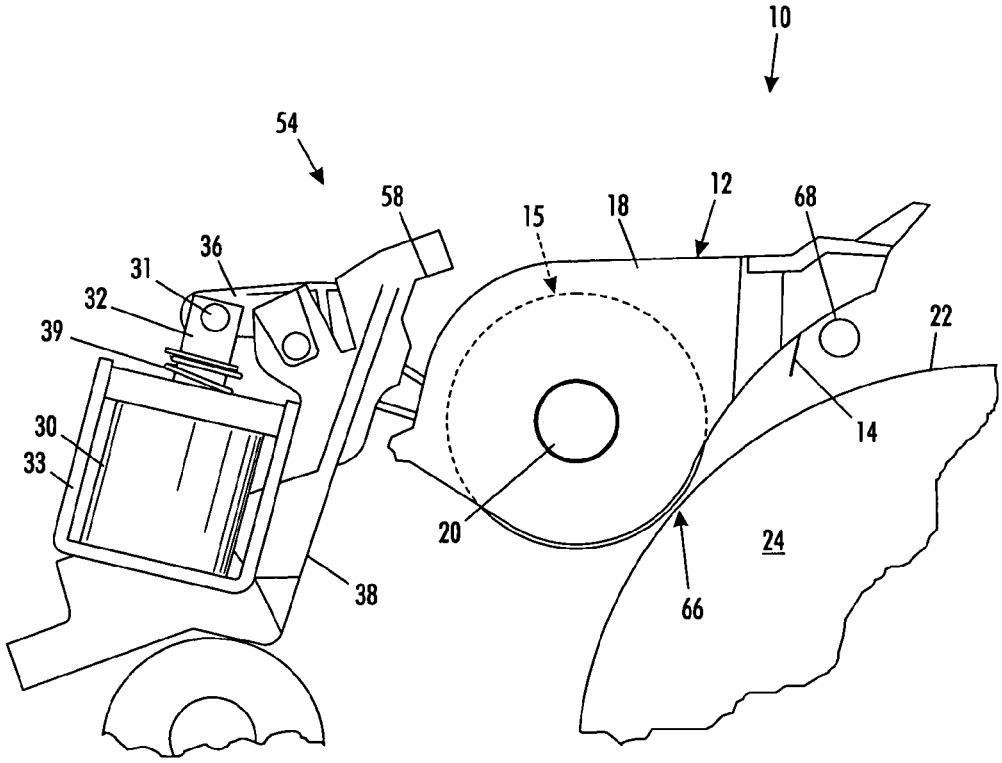
FIG. 3 illustrates a side view of the stripper carriage in a position in which the stripper carriage is ready for printing in an embodiment of the present invention.

The return spring 39 is in a compressed state when the solenoid body 30 is energized and the plunger 32 is in a retracted position, as shown in FIG. 2, and is in an expanded state when the solenoid body 30 is de-energized and the plunger 32 is in an expanded position, as shown in FIG. 3. The ready position 54 is a position in which the parts of the printer are in position to continue with or start printing. The return spring 39 may be, for example, a conical compressing spring.

Figure 4:
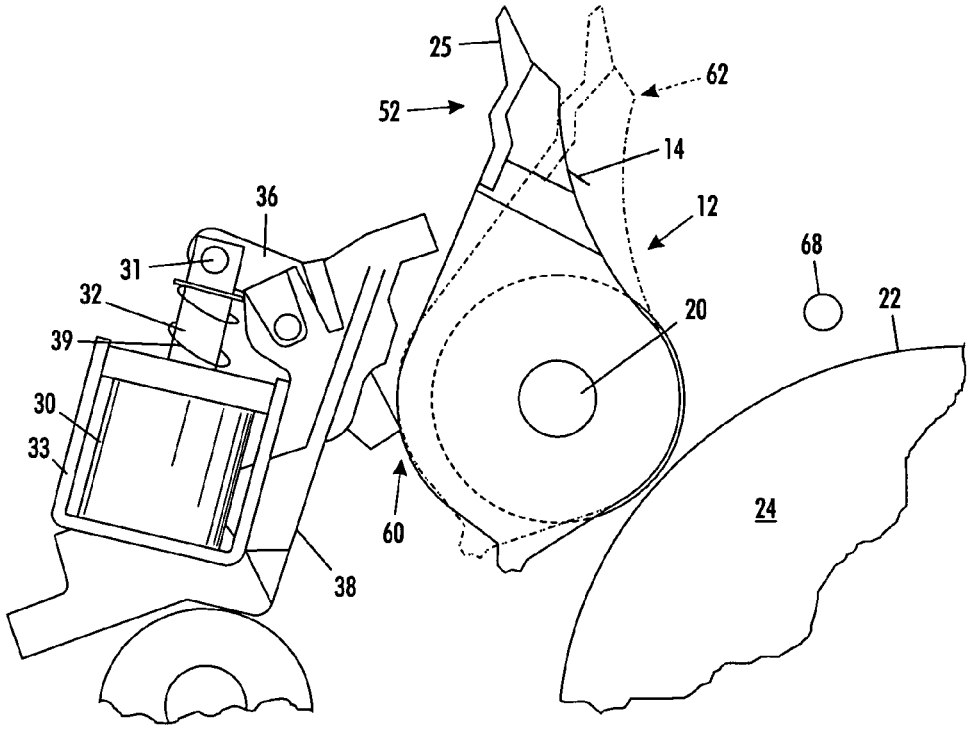
FIG. 4 illustrates a side view of the stripper carriage in a position in which a user may easily access the drum or stripper carriage for maintenance in an embodiment of the present invention.
Figure 5:
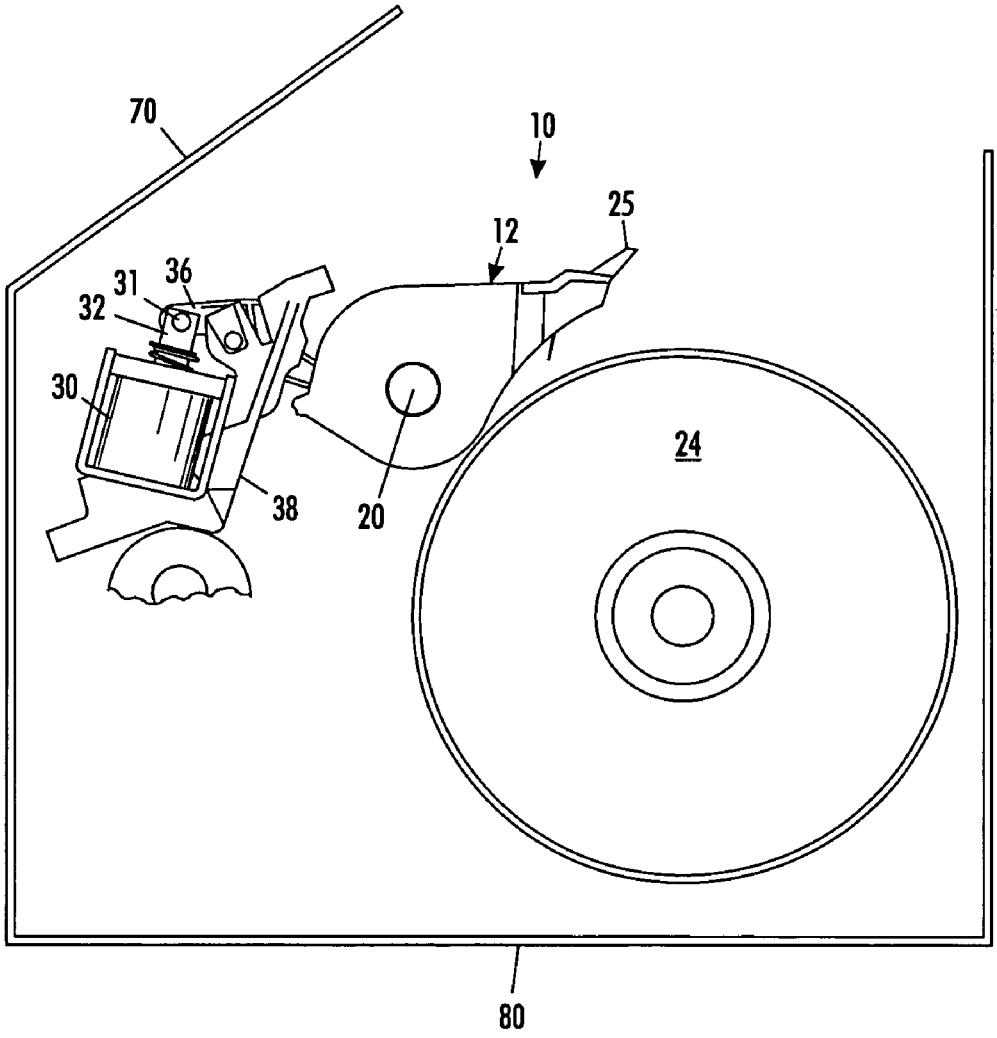
FIG. 5 illustrates a rotatable stripper carriage of an imaging device in an embodiment of the present invention.

Referring to FIG. 4, in an embodiment of the present invention, in a jam clear position 52, a user may easily access the drum 24, drum stripper blade 14, transfix roller 15, and/or other parts of the printer. A force applied to a handle 25 may rotate the stripper carriage assembly 12 back in a counter clockwise direction, thereby rotating the stripper carriage 18, which in turn rotates the lever arm 36, which in turn pulls the plunger 32 from the solenoid body 30 and allows the return spring 39 to expand. Here, the stripper carriage 18 is rotated backward, in a counter-clockwise direction, about the shaft 20 of the transfix roller 15 to provide access to the drum stripper blade 14, transfix roller stripper blade 17, the surface 22 of the imaging drum 24, as well as other areas of the printer. Counterclockwise rotation of the stripper carriage 18 may be stopped by interference with the upper inner duplex guide 40.

Figure 9:
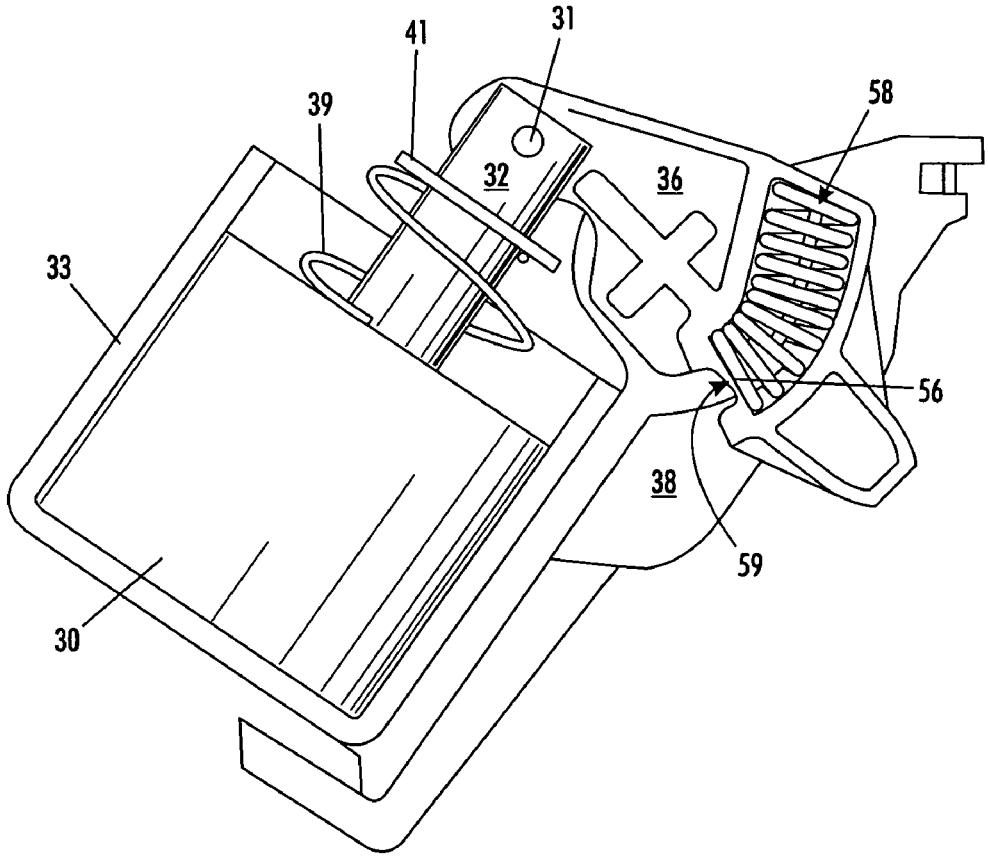
FIG. 9 illustrates a cross-sectional view of a solenoid, solenoid bracket and lever arm of a stripper solenoid assembly in an embodiment of the present invention.
Figure 10:
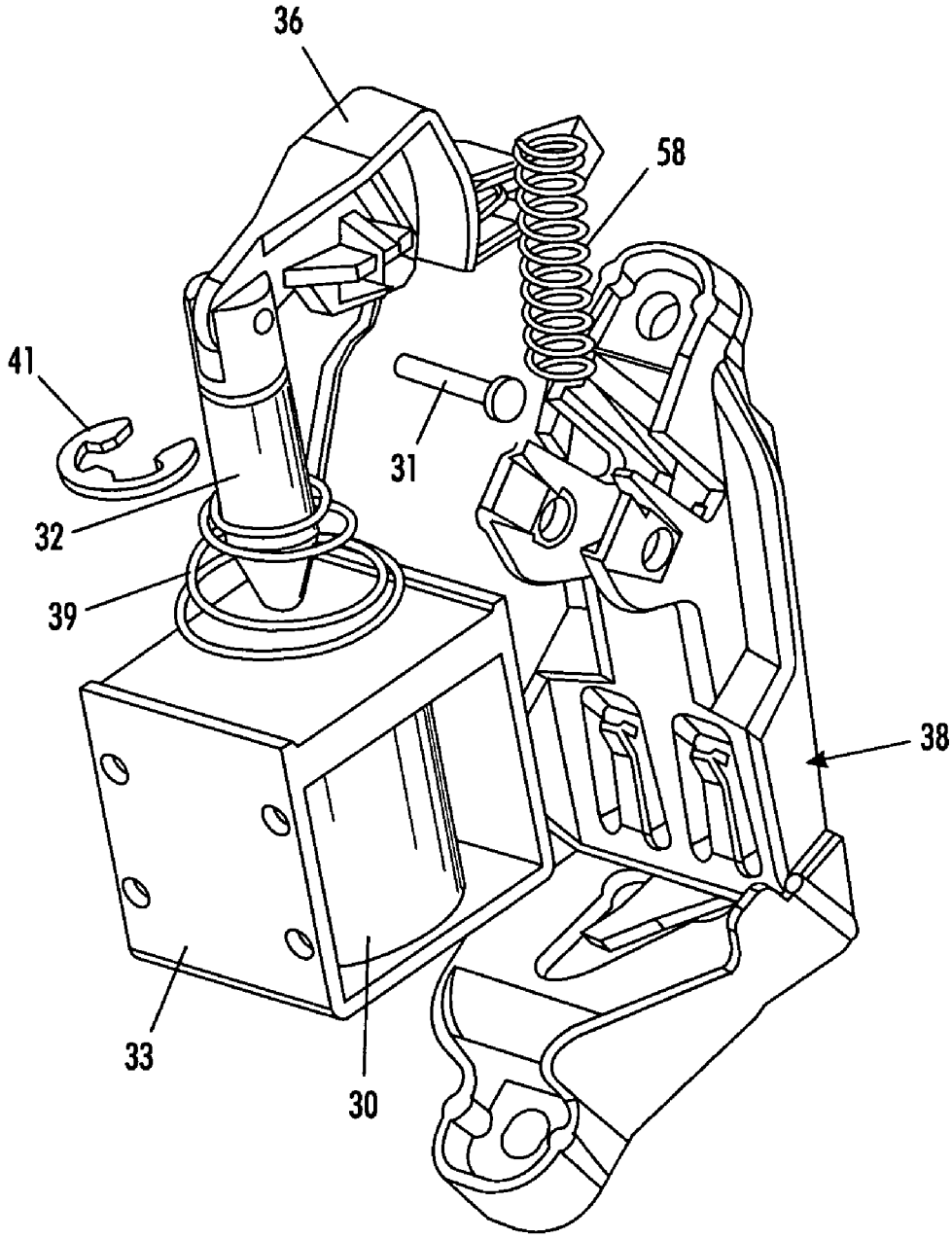
FIG. 10 illustrates an exploded view of the solenoid, solenoid bracket and lever arm of a stripper solenoid assembly in an embodiment of the present invention.
Figure 11:
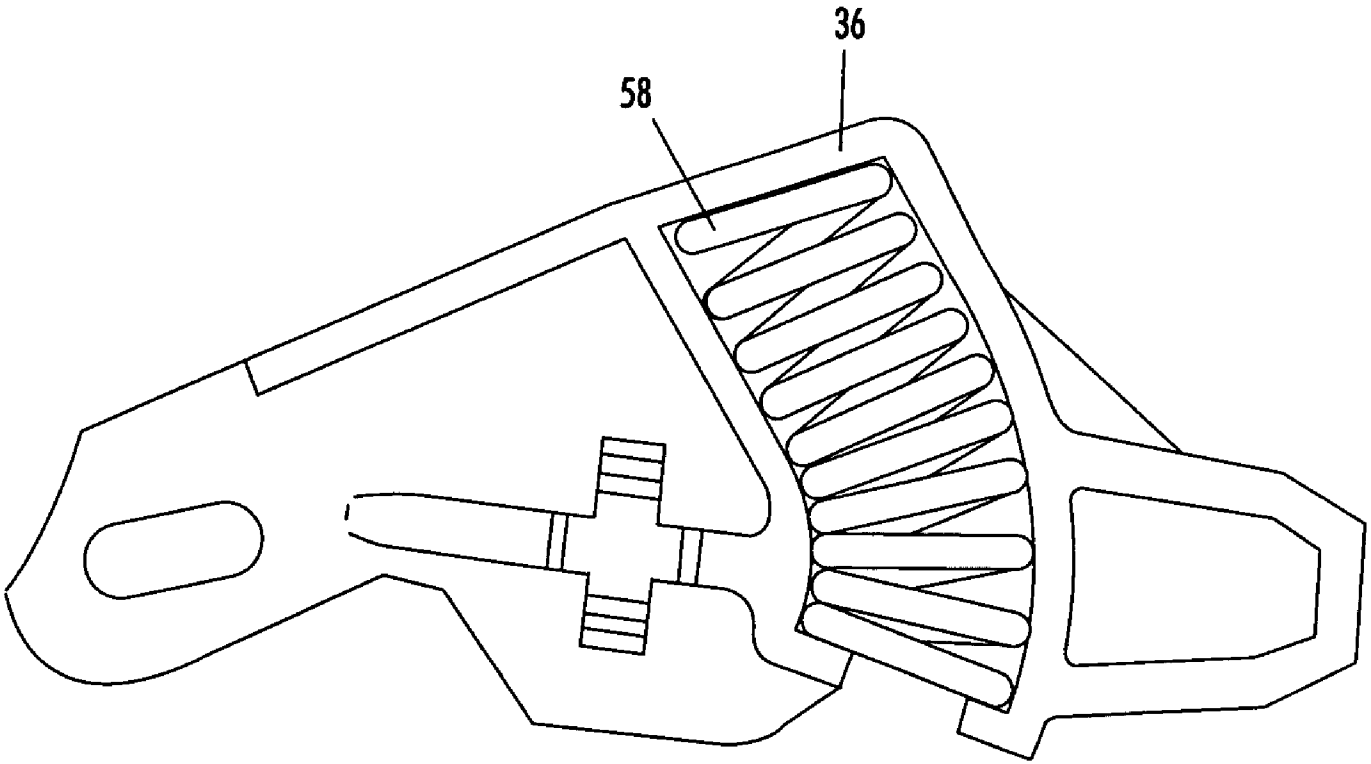
FIG. 11 illustrates a compressed spring and lever arm of a rotatable stripper carriage in an embodiment of the present invention.

In an embodiment of the present invention, a soft stop 56 is implemented to satisfy the functional and usability requirement of a movable but not removable stripper assembly 10. A soft stop 56 creates a system in which there is enough force to locate the stripper carriage assembly 12 in its ready position 54, but not so much force that a user is not able to move the stripper carriage assembly 12 past the soft stop 56. To accomplish this, as shown in FIGS. 9 and 11, a compression spring 58 is preferably provided in the lever arm 36. The return spring 39 creates the force necessary to rotate the lever arm 36 and the stripper carriage assembly 12 until the compression spring 58 contacts a mating surface 59 of the solenoid bracket 38, this interface defines the soft spot 56. This interface also defines the ready position 54 of the stripper assembly 10. There is not enough force in the (now extended) return spring 39 to automatically compress the preloaded compression spring 58. However, a user can easily create enough force to further rotate the stripper carriage assembly 12 back in a counter-clockwise direction, which compresses the compression spring 58 even farther. In this jam clear position 52, the lever arm 36 is a follower and a surface 60 (see FIG. 4) of the stripper carriage 18 acts as a cam.

The cam (the surface 60 of the stripper carriage 18) and follower lever arm 36 and stripper carriage 18 is designed so that the assembly 10 comes to rest in a "hands off" position 62 (see FIG. 4). After a user pulls the handle 25, rotates the stripper carriage assembly 12 to the jam clear position 52, and then releases the handle 25, the stripper carriage assembly 12 may rotate in a clockwise direction and come to rest in the hands off position 62. In the hands off position 62, the assembly 10 will be automatically returned to its ready position 54 when the user closes the door 70 of the imaging device 80. For example, when a user closes the door 70 of the imaging device 80, the stripper carriage assembly 12 is forced to rotate in a clockwise direction and will come to rest at the ready position 54. More specifically, the cam surface 60 on the carriage assembly 10 and the spring force on the lever arm 36 work together to automatically return the carriage 12 to a "hands-off" intermediate position once the user has let go. This intermediate position is such that the carriage is properly positioned to interface with surfaces on the access door. When the access door is closed, surfaces on the door push (rotate) the carriage past an over-center position of the cam surfaces into the "ready" position. The hands off position is set by virtue of the cam 60 and follower mechanism finding a detent position where the follower (lever arm) comes to rest at the smallest radial position of the cam (back surface of the carriage). The system is inclined to rotate toward this low-energy state from the jam clear position. Therefore, it is nearly impossible for the user to fail to successfully return the parts of the imaging device to a ready position 54 after clearing a jam or after opening and then closing the door 70 for any other reason.

Referring again to FIGS. 1–3, in a ready position 54, an outer diameter 22 (the surface 22) of the imaging drum 24 is illustrated. A media 64, such as, for example, paper, is transferred between the drum 24 and the transfix roller 15. Pressure is applied to the media 64 at a nip 66 between the transfix roller 15 and the drum 24. Here, as the paper is moving forward, the transfix roller 15 rotates in a direction opposite to that of the paper. As the paper moves toward an exit, the solenoid body 30 energizes and throws the lever arm 36 such that the stripper carriage assembly 12 rotates until it hits the hard stops 68 (i.e. transfix ground pins 68) (see FIG. 2). The drum stripper blade 14 engages the drum 24 and strips the media 64 from the drum 24. After a leading edge of the paper gets past the drum stripper blade 14, the solenoid body 30 disengages and the return spring 39, around the plunger 32, forces the stripper carriage assembly 12 back up into a ready position 54.

Referring to FIG. 2, the hard stop position 50 is illustrated wherein the drum stripper blade 14 is engaged with the drum 24 and scrapes the drum 24 to remove the media 64 that may be attached thereto. In the event that there is a malfunction and the media 64 is not stripped off of the drum 24, a user may need to manually remove the media 64 from the drum.

Referring to FIG. 6, an example flowchart for maintaining a printer is illustrated. To clear a jam, or to otherwise access a printer for maintenance, a user may open the door 70 of an imaging device, such as, for example, a printer, as shown at step S10. The user may then grasp the handle 25 to rotate the assembly 10 back in a counter clockwise position, as shown at step S20. Here the user may remove any jammed media, clean the blade or other parts of the printer, and/or perform any other required maintenance, as shown at step S30. If necessary, the user may further rotate the assembly 10 or may allow the assembly to rest in the hands off position 62, as shown at step S40. Finally, the user may then manually return the assembly 10 as shown at step S50 or may simply close the door 70, thereby forcing the assembly 10 to rotate forward in a clockwise position to the ready position 54 for printing, as shown at step S60.

It is envisioned that the above described embodiments may be used in association with a number of different devices, such as, for example, printers, copiers, fax machines, and the like. Further, while the embodiments of the present invention are described above, it should be understood that the present invention need not be limited to those embodiments. On the contrary, the present invention is intended to cover all alternatives, modifications, and equivalents as may be included within the spirit and scope of the claims.

What is claimed is:

1. A rotatable stripper blade assembly of an image forming device comprising:

a carriage having a drum blade and a transfix roller blade wherein the drum blade and the transfix roller blade are each attached to the carriage and further wherein the carriage is rotatable about a shaft of a transfix roller.

2. The rotatable stripper blade assembly of claim 1, further comprising:

a lever arm to rotate the carriage.

3. The rotatable stripper blade assembly of claim 1, further comprising:

a retractable plunger attached to a lever wherein retraction of the plunger forces the lever to contact the arm such that a force applied by the contact of the lever to the arm forces the carriage to rotate.

4. The rotatable stripper blade assembly of claim 1, further comprising:

a solenoid housing a plunger wherein the solenoid actuates the plunger; and a lever attached to the plunger, wherein retraction of the plunger forces the lever arm to rotate such that a force applied by the contact of the lever arm rotates the carriage in a first direction.

5. The rotatable stripper blade assembly of claim 4, further comprising:

a bracket supporting the solenoid such that the bracket is attached to the image forming device and remains stationery with respect to the image forming device.

6. The rotatable stripper blade assembly of claim 4, further comprising:

a return spring located around the plunger of the solenoid, wherein the return spring provides a force to rotate the carriage in a second direction.

7. The rotatable stripper blade assembly of claim 6, further comprising:

a compression spring in the lever wherein when the carriage rotates in the first direction, the compression spring contacts the bracket to stop further rotation in the second direction.

8. The rotatable stripper blade assembly of claim 4, further comprising:

a ground pin attached to the imaging device wherein the carriage is made to stop rotation about the shaft of the transfix roller when the carriage contacts the ground pin.

9. The rotatable stripper blade assembly of claim 8, further comprising:

a first load arm attached to the shaft of the transfix roller and a second load arm attached to the ground pin on one end and the shaft of the transfix roller at an other end.

10. The rotatable stripper blade assembly of claim 8, wherein when the carriage contacts the ground pin, the drum blade is in contact with an imaging drum.

11. The rotatable stripper blade assembly of claim 4, further comprising:

a handle attached to the carriage, wherein a force applied to the handle rotates the carriage in a first direction or a second direction.

12. The rotatable stripper blade assembly of claim 1, wherein the carriage rotates in a first direction from an original position to a stop position such that the drum blade makes contact with an imaging drum in the stop position.

13. The rotatable stripper blade assembly of claim 12, wherein when the drum blade makes contact with the imaging drum, at an appropriate point on the imaging drum, the drum blade is set to engage a leading edge of a print medium on the imaging drum advancing on the imaging drum as the drum rotates so as to assist in stripping the print medium from the imaging drum.

14. The rotatable stripper blade assembly of claim 12, wherein the carriage returns to the original position by rotating in a second direction.

15. An image forming device including the rotatable stripper blade assembly of claim 1.

16. A method for maintaining an imaging device having a rotatable stripper blade assembly including a drum blade, a transfix roller blade, and a transfix roller, the method comprising the steps of:

opening a door of the imaging device;

rotating the rotatable stripper blade assembly about an axis of the transfix roller in a first direction;

providing maintenance of the imaging device; and rotating the rotatable stripper blade assembly to a position in which the imaging device is ready to process images.

17. The method of claim 16, further comprising the step of:

applying a force to a handle of the rotatable stripper blade assembly to rotate the rotatable stripper blade assembly about the axis of the transfix roller in the first direction.

18. The method of claim 16, further comprising the step of:

further manually rotating the rotatable stripper blade assembly in the first or a second direction.

19. The method of claim 16, further comprising the step of:

automatically returning the rotatable stripper blade assembly to a position in which the imaging device is ready to process images by closing the door.

20. The method of claim 16, further comprising the step of:

returning the rotatable stripper blade assembly to a position in which the imaging device is ready to process images by manually applying a force in a second direction to a handle of the rotatable stripper blade assembly.

* * * * *